US006767883B2

(12) United States Patent
Barbuzzi et al.

(10) Patent No.: US 6,767,883 B2
(45) Date of Patent: Jul. 27, 2004

(54) FABRIC CARE COMPOSITIONS

(75) Inventors: Elena Barbuzzi, Bebington (GB); Anthony Nicholas Jarvis, Bebington (GB); Nicola Whilton, Bebington (GB)

(73) Assignee: Unilever Home & Personal Care USA division of Conopco, Inc., Greenwich, CT (US)

( * ) Notice: Subject to any disclaimer, the term of this patent is extended or adjusted under 35 U.S.C. 154(b) by 270 days.

(21) Appl. No.: 10/136,015

(22) Filed: Apr. 30, 2002

(65) Prior Publication Data

US 2002/0192367 A1 Dec. 19, 2002

(30) Foreign Application Priority Data

Apr. 30, 2001 (EP) ..... 01303913

(51) Int. Cl.[7] ..... C11D 9/36
(52) U.S. Cl. ..... 510/441; 510/349; 510/466
(58) Field of Search ..... 510/349, 441, 510/466

(56) References Cited

U.S. PATENT DOCUMENTS 4,400,288 A * 8/1983 Dhanani et al. ..... 510/347
4,447,349 A * 5/1984 Tai ..... 510/347
4,732,694 A * 3/1988 Gowland et al. ..... 516/117
4,818,292 A * 4/1989 Iley et al. ..... 106/210.1
4,844,980 A * 7/1989 Gruning et al. ..... 428/405
5,238,596 A * 8/1993 Smith ..... 510/441
5,376,301 A * 12/1994 Fleuren et al. ..... 510/278
5,629,278 A * 5/1997 Baeck et al. ..... 510/236

FOREIGN PATENT DOCUMENTS

WO WO 95/02665 1/1995

OTHER PUBLICATIONS

International Search Report on PCT/EP 02/ 03847 dated Jul.11, 2002.

* cited by examiner

*Primary Examiner*—Charles Boyer
(74) *Attorney, Agent, or Firm*—Alan A. Bornstein

(57) ABSTRACT

A method of treating fabric comprising the step of applying to the fabric a fabric treatment composition comprising a coated particles comprising:
a solid core having a D3,2 average particle size in the range from 10 to 700 nm, and a coating of silicone polymer covalently bonded to the solid core.

14 Claims, No Drawings

FABRIC CARE COMPOSITIONS

TECHNICAL FIELD

This invention relates to a method of treating fabric with fabric care compositions and to the use of such fabric care compositions.

BACKGROUND AND PRIOR ART

The sensory feel of a fabric following conventional laundering processes is an important property. In particular, the "softness" of a fabric is a highly desirable quality in the laundered fabric. The term "softness" generally refers, for example, to the feeling of smoothness to the touch and flexibility of the fabric. In addition, the term "softness" refers to the general feeling of comfort registered by the human skin on contact with the fabric.

However, although fabric softness is a desired sensory attribute it is also desirable that fabrics feel crisp and new. A good example of this that a shirt should feel soft to the skin and yet still feel crisp when worn rather than feel limp.

When conventional softening systems have been used such as cationic softening systems the crisp feel of the fabric has been sacrificed for the soft feel.

Starch is a conventional material used to stiffen fabrics and impart body to them. However, starch makes the fabric feel harsh.

It remains desirable to have improved systems for treating fabric that provide fabric softness and yet allow the fabric to feel crisp and have body.

The present invention aims to provide a method of treating fabrics that renders their feel soft yet crisp. The treated fabrics also exhibit body and volume.

STATEMENT OF INVENTION

According to the present invention, there is provided a method of treating fabric comprising the step of applying to the fabric:

a coated particle comprising:

(a) a solid core having a D3,2 average particle size in the range from 10 to 700 nm, and (b) a coating of silicone polymer covalently bonded to the solid core.

The invention further relates to a fabric treatment composition comprising i) a coated particle comprising:

a solid core having a D3,2 average particle size in the range from 10 to 700 nm, and a coating of silicone polymer covalently bonded to the solid core and;

ii) any one of the group selected from builder, fabric softening compound, bleaching system or enzyme.

In another aspect of the invention, use of a coated particle comprising a solid core having a D3,2 average particle size in the range from 10 to 700 nm, and a coating of silicone polymer covalently bonded to the solid core to impart a crisp feel to the fabric.

In yet another aspect of the invention, there is provided use of a coated particle comprising a solid core having a D3,2 average particle size in the range from 10 to 700 nm, and a coating of silicone polymer covalently bonded to the solid core to impart a soft feel to the fabric.

In yet another further aspect of the invention, there is provided use of a coated particle comprising a solid core having a D3,2 average particle size in the range from 10 to 700 nm, and a coating of silicone polymer covalently bonded to the solid core to impart body to the fabric.

DETAILED DESCRIPTION OF THE INVENTION

It has been found that fabric care compositions comprising coated particle substance imparts a soft yet crisp feel and body to fabric.

Definitions

Unless specified otherwise, all wt % values quoted hereinafter are percentages by weight based on total weight of the shampoo composition.

As used hereinafter, the term "coated particle" refers to a particle comprising a solid core having a D3,2 average particle size in the range 10 to 700 nm which is coated, via covalent grafting, with a silicone polymer, the polymer forming a coating or shell around the solid core. Which is insoluble in water.

As used hereinafter, the term "solid core" or "solid core particle" refers to the solid core of the coated particle, which is insoluble in water.

As used hereinafter, the term "coating polymer" or "polymer coating" refers to the silicone polymer covalently grafted to the solid core of the coated particle.

By "insoluble" is meant that the material is not soluble in water (distilled or equivalent) at a concentration of 0.1% (w/w), at 250° C.

As used hereinafter, the term "aggregates" refers to secondary particles which are a collection of primary particles which have been fused to form face to face sintered structures which cannot be dissociated, and as such are relatively hard.

D3,2 average droplet or particle sizes as referred to herein may be measured by means of a laser light scattering technique, using a 2600D Particle Sizer from Malvern Instruments.

Coated Particles

The fabric care composition typically from 0.1% to 30% by weight of a coated particle. More preferably the level of coated particle is from 2 to 10%.

Preferred-coated particles and their preparation are described in JP 10/114 622.

The coated particles comprise solid cores having D3,2 average particle sizes in the range from 10 to 700 nm, the solid cores being coated with a silicone polymer which is covalently bonded to the solid core.

Preferably, the D3,2 average particle size of the coated particles is in the range from 20 to 1000, more preferably from 20 to 800, yet more preferably from 50 to 500 and most preferably from 50 to 250 nm.

Sufficient silicone is grafted so as to form an effective shell around the solid core. Suitably, the weight ratio of the solid core to the silicone coating polymer is in the range from 20:1 to 1:10, preferably from 20:1 to 2:3, more preferably from 20:1 to 1:1, more preferably from 10:1 to 1:1, yet more preferably from 5:1 to 1:1, and most preferably from 5:1 to 2:1. A particularly preferred ratio is about 4:1.

Solid Core

The solid core particles have a D3,2 average particle size in the range from 10 to 700, preferably from 10 to 500, more preferably from 20 to 300, yet more preferably from 20 to 200, and most preferably from 30 to 150 nm, for example about from 50 to 100 nm.

It is preferred that the solid core particles be colloidal in an aqueous dispersion.

The solid core can be a primary particle or an aggregate, so long as its satisfies the size requirement specified above. Suitably, the solid core particles are relatively hard and typically have a Youngs Modulus of more than 4, preferably more than 5, more preferably more than 6, and yet more preferably more than 10 GPa. A preferred category of compounds typically has a Youngs Modulus in the range of from 20 to 100, preferably from 40 to 90, and more preferably from 50 to 90 GPa.

The solid core material can be organic or inorganic in nature. Furthermore, the solid core may be composed entirely of one material or may consist of a composite of materials.

Suitable organic solid particles can be made by a variety of methods including:

(i) via the synthesis of (co)polymers as described in, for example, Breiner et al. (1998) *Macromolecules,* Vol. 31, 135; and (ii) via the synthesis of cross-linked polymer structures as described in, for example:

Ishizu & Fukutomi (1988) *J. Polym. Sci., Part C: Polym. Lett.,* Vol. 26, 281;

Saito et al. (1990) *Polymer,* Vol. 31, 679;

Thurmond et al. (1997) *J. Am. Chem. Soc.,* Vol. 119, 6656; and

Stewart & Liu (2000) *Angew. Chem. Int. Ed.,* Vol. 39, 340).

Suitable inorganic solid particles can be prepared by techniques such as:

(i) precipitation, as described in, for example, Matjievic (1993) *Chem. Mater.,* Vol. 5, 412;

(ii) dispersion, as described in, for example, Stober et al. (1968) *J. Colloid Interface Sci.,* Vol. 26, 62; and Philipse & Vrij (1989) *J. Colloid Interface Sci.,* Vol. 129, 121);

(iii) microemulsion processes, as described in, for example, Baumann et al. (1997) *Adv. Mater.,* Vol. 9, 995; and (iv) sol-gel processes, as described in, for example:

Forster & Antonietti (1998) *Adv. Mater.,* Vol. 10, 195;

Kramer et al. (1998) *Langmuir,* Vol. 14, 2027;

Hedrick et al. (1998) *Adv. Mater.,* Vol. 10, 1049;

Zhao et al. (1998) D. *Science,* Vol. 279, 548; and

Ulrich et al. (1999) *Adv. Mater.,* Vol. 11, 141.

Examples of suitable solid core materials for use as the solid cores include cross-linked polymers (e.g. polystyrene, silicone elastomer powders), PTFE, silicas, alumina, alumino silicate, colloidal metals (e.g. titanium dioxide).

One preferred class of material is PTFE. PTFE solid core particles may be composed entirely of PTFE polymer or may consist of a composite of PTFE polymer and one or more further polymers such as polyethylene. Suitable PTFE particles are further described in our unpublished co-pending United Kingdom Patent Application Nos. GB 0012064.2 and GB 0012061.8.

Another preferred classes of materials are silicas, such as silica gels, hydrated silicas and precipitated silicas (e.g. Cab-O-Sil and Aerosil).

A particularly preferred class of solid core materials is colloidal silicas. Suitable examples include Ludox HS-40, Ludox SM, Ludox CL and Ludox AM.

Suitably, the solid core amounts to from 95 to 5 wt %, preferably from 95 to 40, more preferably from 90 to 50, and most preferably from 90 to 60 wt %, for example about 80 wt %, of the total weight of the coated particles.

Coating Polymer

The coating polymer is a silicone polymer that is covalently bonded to the solid core.

Suitably, the coating polymer amounts to from 5 to 95, preferably from 10 to 60, more preferably from 10 to 50, and most preferably from 10 to 40 wt %, for example about 20 wt %, of the total weight of the coated particles.

Suitably, the molecular weight of the coating polymer is no greater than 500,000, preferably no greater than 250,000, more preferably no greater than 200,000, yet more preferably no greater than 150,000 and most preferably no greater than 100,000.

The silicone polymer is tethered to the surface of the solid core particle by one or more covalent bonds, although other secondary means of attachment such as hydrogen bonding and absorption may also be present. The silicone polymer may be bonded via its terminal end(s) and/or via side-chains in the polymer chain. Preferably at least 70 wt %, more preferably at least 80 wt % and yet more preferably at least 90 wt % of the silicone polymer present in coating on the solid core is covalently bonded to the solid core surface.

More than one silicone polymer may be used to coat the solid core.

Suitable silicone polymers for use as the coating polymer are polyorganosiloxanes represented by the formula I:

$$R^1_aSiO_{(4-a)/2} \quad (I)$$

in which $R^1$ is a hydrogen atom or a substituted or unsubstituted hydrocarbon group; and a is 1.80–2.20.

Examples of suitable unsubstituted hydrocarbon groups include (i) linear or branched C1–20 alkyls group; (ii) aryl groups such as benzyl, β-phenylethyl, methylbenzyl and naphthylmethyl groups; and (iii) cycloalkyl groups such as cyclohexyl and cyclopentyl.

Examples of suitable substituted hydrocarbon groups include (i) groups where hydrogen atom(s) of the above-mentioned unsubstituted hydrocarbon groups is/are substituted with halogen atom(s) such as fluorine or chlorine, for example 3,3,3-trifluoropropyl and fluoropropyl groups; (ii) groups containing an ethylenic unsaturated group; and (iii) groups containing an organic functional group containing at least one oxygen or nitrogen atoms.

Suitable organic functional groups include:

$-CH_2CH_2CH_2NH_2$ $-CH_2CH_2CH_2NHCH_2CH_2NH_2$ $-CH_2CH_2CH_2NHCH_2CH_2NHCH_2CH_2NH_2$

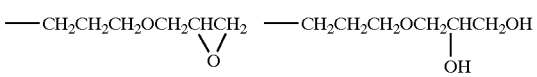

$-CH_2CH_2CH_2SH$

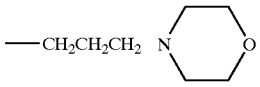

-continued

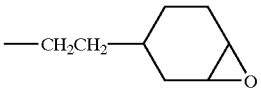

Suitable ethylenic unsaturated groups include the following, in which n is an integer from 0 to 10:

$$CH_2{=}CH{-}O{-}(CH_2)_n \quad (a)$$

suitable examples being vinyloxyethyl and vinyloxyethoxy groups, and preferably vinyloxypropyl and vinyloxyethoxypropyl groups;

$$CH2{=}CH{-}(CH2)_n \quad (b)$$

suitable examples being homoallyl, 5-hexenyl and 7-octenyl groups, and preferably vinyl and allyl groups;

(c)

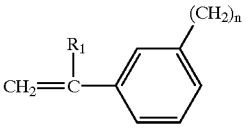

in which $R^1$ is a hydrogen atom or a C1–6 alkyl group, preferably a hydrogen atom or methyl group.

Suitable examples include (vinylphenyl)methyl, isopropenylvinylphenyl, 2-(vinylphenoxy)ethyl, 3-(vinylbenzoyloxy)propyl, 3-(isopropenylbenzoylkoxy)propyl, and 3-(isopropenylbenzoyloxy)propyl groups. Preferred groups are vinylphenyl, 1-(vinylphenyl)ethyl and 2-(vinylphenyl)ethyl groups;

(d)

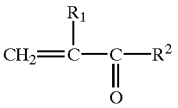

in which $R^2$ is a C1–6 alkylene group or a group represented by the formula $$-O-,\ S- \text{ or } -N(R^3)R^4-$$

where $R^3$ is a C1–6 hydrocarbon or a (meth)acryloyl group, and $R^4$ is a C1–6 alkylene group.

Suitable examples include γ-acryloxypropyl, γ-methacrylaoxypropyl and N,N-bis(methacryloyl)-γ-aminopropyl groups. Preferred groups are N-methacryloyl-N-methyl-γ-aminopropyl and N-acryloyl-N-methyl-γ-aminopropyl groups.

Preparation of Coated Particles

The coated particles are preferably prepared as an aqueous pre-emulsion, which can then be mixed with other ingredients to form the shampoo composition.

Different methods of preparation may be used depending of the size of coated particles required. Suitably, the coated particles can be prepared as follow:

(i) "Large" Coated Particles

Larger coated particles, for example having a D3,2 average particle size of at least 100 nm and which employ solid core particles having D3,2 average particle size of at least 50 nm, can be prepared in an aqueous polymerisation system in which the solid core particles are mixed with water, an emulsifying surfactant, an organosiloxane component and a suitable polymerisation catalyst. The resulting aqueous emulsion of coated particles can be directly incorporated into a shampoo composition.

(ii) "Small" Coated Particles

Smaller coated particles, for example having a D3,2 average particle size of less than 100 nm and which employ solid core particles having D3,2 average particle size of less than 50 nm, tend to have to be prepared by an alternative organic polymerisation system in which the solid core particles are mixed with an organosiloxane component in an organic solvent, free of any surfactant. The resulting coated particles are typically precipitated out of the organic solvent, washed and redispersed in water as an aqueous emulsion with a suitable emulsifying surfactant.

Organosiloxane Units

The silicone-coating polymer is suitably prepared by polymerisation of component monomers or oligomers. Typically, the solid core particles are mixed with organosiloxane units having 2-10 silicon atoms and containing no hydroxyl groups and being of unit formula (II):

$$R^1{}_nSiO_{(4-n)/2} \quad (II)$$

in which $R^1$ is a hydrogen atom or a substituted or unsubstituted hydrocarbon group.

A cross-linking agent such as a silane compound having a functional group may be added to the organosiloxane component for the silicone coat so as to improve the strength of the polymer shell.

Examples of suitable organosiloxane component units from which the polyorganosiloxane coating polymer is formed by the condensation reaction are as follows:

(i) Cyclic compounds such as hexamethyl cyclotrisiloxane, octamethyl cyclotetrasiloxane, decamethyl cyclopentasiloxane, 1,3,5,7-tetramethyl-1,3,5,7-tetraphenyl cyclotetrasiloxane, 1,3,5,7-tetrabenzyltetramethyl cyclotetrasiloxane and 1,3,5,7-tris(3,3,3-trifluoropropyl)trimethylsiloxane;

(ii) Cyclic organosiloxanes containing an organic functional group such as trimethyl triphenyl cyclotrisiloxane, tris(3,3,3-aminopropyl) tetramethyl cyclotetrasiloxane, 1,3,5,7-tetra[N-(2-aminoethyl)-3-aminopropyl] tetramethyl cyclotetrasiloxane, 1,3,5,7,-tetra(3-mercaptopropyl) tetramethyl cyclotetrasiloxane and 1,3,5,7,-tetra(3glycidoxypropyl) tetramethyl cyclotetrasiloxane.

(iii) Cyclic and linear organosiloxanes having an ethylenically unsaturated group such as 1,3,5,7-tetra(3-methacryloxypropyl) tetramethyl cyclotetrasiloxane, 1,3,5,7-tetra(3-acryloxypropyl) tetramethyl cyclotetrasiloxane, 1,3,5,7-tetra(3-carboxypropyl) tetramethyl cyclotetrasiloxane, 1,3,5,7-tetra(vinyloxypropyl) tetramethyl cyclotetrasiloxane, 1,3,5,7,-tetra(vinyloxyethoxypropyl) tetramethyl tetracyclosiloxane, 1,3,5,7-tetra(p-vinylphenyl) tetramethyl cyclotetrasiloxane, 1,3,5,7,-tetra[1-(m-vinylphenyl)methyl] tetramethyl cyclotetrasiloxane, 1,3,5,7,-tetra[2(p-vinylphenyl)ethyl] tetramethyl cyclotetrasiloxane, 1,3,5,7-tetra[3-(p-vinylphenoxy)propyl] tetramethyl cyclotetrasiloxane, 1,3,5,7,-tetra[3-(p-vinylbenzoyloxy)propyl tetramethyl tetracyclosilaoxane, 1,3,5,7,-tetrea[3-(p-isopropenylbenzoylamino)propyl] tetramethyl tetracyclosiloxane, 1,3,5,7,-tetra(N-methacryloyl-N-methyl-3-aminopropyl) tetramethyl cyclotetrasiloxane, 1,3,5,7,-tetra(N-acryloyl-N-methyl-3-aminopropyl) tetramethyl cyclotetrasiloane, 1,3,5,7,-tetra[N,N-bis (methacryloyl)-3-aminopropyl] tetramethyl cyclotetrasiloxane, 1,3,5,7-tetra[N,N-bis(acryloyl)-3-aminopropyl] tetramethyl cyclotetrasiloxane, 1,3,5,7-tetravinyl tetramethyl cyclotetrasiloxane, octavinyl cyclotetrasiloxane, 1,3,5-trivinyl trimethyl cyclotrisiloxane, 1,3,5,7-tetraallyl tetramethyl cyclotetrasiloxane, 1,3,5,7-tetra(5-hexenyl) tetramethyl cyclotetrasiloxane, 1,3,5,7-tetra(7-oxenyl) tetramethyl cyclotetrasiloxane and 1-(p-vinylphenyl)-1,1-diphenyl-3-diethoxy disiloxane.

Examples of suitable silane compounds which may be added to the organosiloxane component for the silicone coat so as to improve the strength of the polymer shell are as follows:

(i) Silane compounds having an organic functional group such as 3-aminopropylmethyl dimethoxysilane, 3-aminopropyltrimethoxysilane, N-(2-aminoethyl)-3-aminopropyl trimethoxysilane,N-triethylenediaminepropylmethyl dimethoxysilane, 3-glycidoxypropylmethyl dimethoxysilane, 3,4-epoxycyclohexylethyl trimethoxysilane, 3-mercaptopropyl trimethoxysilane, trifluoropropyl trimethoxysilane and 3-carboxypropylmethyl dimethoxysilane.

(ii) Silane compounds having an ethylenic unsaturated group such as 3-acryloxypropyl triethoxysilane, 3-methacryloxypropyl trimethoxysilane,(vinyloxypropyl) methyl dimethoxysilane, (vinyloxyethoxypropyl)methyl dimethoxysilane, p-vinylphenylmethyl dimethoxysilane, 1-(m-vinylphenyl)methyldimethyl isopropoxysilane, 2-(p-vinylphenyl)ethyldimethoxysilane, 3-(p-vinylphenoxy)propylmethyl dimethoxysilane, 1-(p-vinylphenyl)ethylmethyl methoxysilane, 1-(o-vinylphenyl)-1,1,2-trimethyldimethoxydisilane, m-vinylphenyl[(3-triethoxysilyl)propl] diphenylsilane, [3-(p-isopropenylbenzoylamino)propyl] diphenyldipropoxysilane, N-methacryloyyl-N-methyl-3-aminopropylmethyl dimethoxysilane, N-acryloyl-N-methyl-3-aminopropylmethyl dimethoxysilane, N,N-bis (methacryloyl)-3-aminopropyl methoxysilane, N,N-bis (acryloyl)-3-aminopropylmethyl dimethoxysilane, N-methacryloyl-N-methyl-3-aminopropylphenyl diethoxysilane, 1-methacryloylpropylol,1,3-trimethyl-3, 3-dimethoxydisiloxane, vinylmethyl dimethoxysilane, vinylethyl diisoproposysilane, allylmethyl dimethoxysilane, 5-hexenylmethyl diethoxysilane and 3-octenylethyl diethoxysilane.

Any of the organosiloxanes or silanes can be used either singly or as a mixture of two or more organosiloxanes and/or silanes.

Besides the above-mentioned silicones, linear or branched organosiloxane oligomers may also be used as an organosiloxane containing an organic functional group or an ethylenic unsaturated group. In the case of such organosiloxane oligomers, although there is no particular limitation for the terminal group of the molecular chain terminal is sequestered by an organic group other than a hydroxyl group such as an alkoxy group, trimethylsilyl group, dimethylvinylsilyl group, methylphenylvinylsilyl group, methyldiphenylsilyl group and 3,3,3-trifluoropropyldimethylsilyl group.

Emulsifying Surfactant

Any surfactant materials either alone or in admixture may be used as emulsifiers in the preparation of the pre-emulsions of coated particles. Suitable emulsifiers include anionic, cationic and nonionic emulsifiers.

Examples of anionic emulsifiers are alkylarylsulphonates, e.g., sodium dodecylbenzene sulphonate, alkyl sulphates e.g., sodium, lauryl sulphate, alkyl ether sulphates, e.g., sodium lauryl ether sulphate nEO, where n is from 1 to 20 alkylphenol ether sulphates, e.g., octylphenol ether sulphate nEO where n is from 1 to 20, and sulphosuccinates, e.g., sodium dioctylsulphosuccinate.

Suitable cationic surfactants are well known to the person skilled in the art. Preferably, the cationic surfactant contains a quaternary ammonium group. Suitable examples of such cationic surfactants are described hereinbelow in the section on co-surfactants. Particularly preferred as cationic emulsifying surfactants are C6-20, preferably C8–18, monoalkyl and dialkyl quaternary ammonium compounds.

Examples of nonionic emulsifiers are alkylphenol ethoxylates, e.g., nonylphenol ethoxylate nEO, where n is from 1 to 50, alcohol ethoxylates, e.g., lauryl alcohol nEO, where n is from 1 to 50, ester ethoxylates, e.g., polyoxyethylene monostearate where the number of oxyethylene units is from 1 to 30.

Preferably, at least one anionic surfactant or cationic surfactant is present as an emulsifying surfactant.

(i) Aqueous Polymerisation System

In this process, the solid core particles are mixed with water, an emulsifying surfactant, an organosiloxane component and a suitable polymerisation catalyst. Preferred methods for preparing coated particles according to this system are described in JP 10114622.

Any catalyst may be used so long as it is capable of polymerising a low-molecular organosiloxane in the presence of water. Suitable catalysts include those commonly used for polymerisation of low-molecular organosiloxanes such as a mixture of hydroxylated aliphatic sulphonic acid with an unsaturated aliphatic sulphonic acid, an aliphatic hydrogen sulphate, an aliphatic substituted benzenesulphonic acid, hydrochloric acid, sulphuric acid, phosphoric acid.

Certain anionic surfactant emulsifiers have a weak catalytic action such can be used in conjunction with a polymerisation catalyst. Such anionic surfactants include sodium dodecylbenzenesulphonate, sodium octylbenzenesulphonate, ammonium dodecylbenzenesulphonate, sodium lauryl sulphate, ammonium lauryl sulphate, triethanolamine lauryl sulphate, and sodium tetradecenesulphonate and sodium hydroxytetradecenesulphonate.

Cationic surfactant emulsifiers can also have a weak catalytic action and, therefore, it is preferred to use them together with a polymerisation catalyst such as an alkaline metal hydroxide (e.g., lithium hydroxide, sodium hydroxide, potassium hydroxide, potassium hydroxide, rubidium hydroxide and caesium hydroxide).

The amount of water used in the emulsification is typically from 50 to 500, preferably from 100 to 300 parts by weight to 100 parts by weight of the total amount of the coated particles component in the emulsion. The solid concentration in the emulsion is typically from 20 to 70, preferably from 30 to 60 wt % of the total weight of the emulsion. The temperature of preparation of the emulsion (i.e. for the condensation reaction) is typically in the range from 5 to 100° C.

The amount of emulsifying surfactant in the emulsification is typically from 0.5 to 50, preferably from 0.5 to 20 parts by weight of the total amount of the coated particles component in the emulsion.

The amount of polymerisation catalyst in the emulsification is typically from 0.05 to 10 parts by weight of the total amount of the coated particles component in the emulsion.

As already mentioned, a preferred solid core material of the present invention is colloidal silica. In the emulsification step, this is present as an aqueous dispersion with $SiO_2$ as the basic unit of the solid core particles. Ordinarily, colloidal silica is classified into acidic and alkaline subclasses based upon its Characteristics and any of them may be appropriately selected and used depending upon the condition for the emulsification polymerisation. When using acidic silica, the emulsifying surfactant should be an anionic surfactant, and conversely, when using an alkaline silica, the emulsifying surfactant should be a cationic surfactant, in order to keep the silica in a stable state.

In a preferred embodiment, the emulsifying surfactant is an anionic surfactant. Thus when using silica as the solid core, preferably acidic silica is used.

(ii) Organic Polymerisation System

In this process, the solid core particles are mixed with an organosiloxane component in an organic solvent, free of any surfactant. The resulting coated particles are typically precipitated out of the organic solvent, washed and redispersed in water with a suitable emulsifying surfactant to form an aqueous emulsion. Preferred methods for preparing coated particles according to this system are described in Pyun et al. (2001) *Polym. Prepr.* (*Am. Chem. Soc., Div. Polym. Chem.*), Vol. 42(1), 223.

A suitable method for preparing "smaller" coated particles, for example in which the solid core particles have a D3,2 average particle size of 10 to 20 nm. is a microemulsion process. An example of a suitable microemulsion process for the preparation of silica solid cores coated with silicone polymer is as follows. Silica colloid is prepared in an aqueous medium (e.g. 6 mM NaOH) by the reaction of methyltrimethoxysilane within micelles in the presence of an emulsifying surfactant (e.g. a quaternary ammonium cationic surfactant). The presence of the surfactant around the particles prevents large-scale flocculation. In order to prevent the colloid particles aggregating via residual surface silanol groups, the surface silanol groups of the silica colloid are silylised. Firstly, whilst still in the aqueous medium, surface silanol groups are reacted with methoxytrimethylsilane to generate trimethylsilyl groups. The particles are then precipitated into an appropriate organic solvent (e.g. methanol) to remove the surfactant, and subsequently redispersed in an appropriate organic solvent (e.g. tetrahydofurnan). The transfer from aqueous to organic solvent is necessary to achieve complete silylisation of the surface silanol groups and thus obtain stable colloids. Any residual silanol groups are deactivate and 2-bromoisobutyrate groups incorporated onto the surface of the particles by reacting the colloid particles in an appropriate organic solvent with 3-(2-bromoisobutyryloxy)-propylchlorodimethylsilane and 1,1,1,3,3,-hexamethyldisilazane. The functionalised silica colloids can then be purified by precipitation, e.g. in methanol, and dialysis in acetone. The functionalised silica colloids are then coated by reaction with organosiloxane units in an atom transfer radical polymerisation (ATRP) to form coated particles.

The coated particles are finally precipitated out of the organic solvent, for example, into methanol, washed (e.g. with acetone) and redispersed in water with a suitable emulsifying surfactant to form an aqueous pre-emulsion of coated particles.

Preferably, whatever method of preparation is used, the emulsifying surfactant present in the aqueous pre-emulsion of coated particles is an anionic surfactant.

The pre-emulsions of the coated particles have a tendency to be either acidic or alkaline in nature. In order to keep them stable over a long period, they are neutralised by adding alkali or acid. Examples of suitable alkali neutralising agents are sodium hydroxide, thorium carbonate, thorium bicarbonate and triethanolamine. Examples of suitable acidic neutralising agents are hydrochloric acid, sulphuric acid, nitric acid, acetic acid and oxalic acid.

Fabric Treatment Compositions

The compositions of the invention preferably comprise a perfume, such as of the type which is conventionally used in fabric care compositions. The compositions may be packaged and labelled for use in a domestic laundering process.

If the composition of the invention is to be used before, or after, the laundry process it may be in the form of a spray or foaming product. The laundering processes of the present invention include the large scale and small scale (eg domestic) cleaning of fabrics. Preferably, the processes are domestic.

In the invention, the composition of the invention may be used at any stage of the laundering process. Preferably, the composition is used to treat the fabric in the rinse cycle of a laundering process. The rinse cycle preferably follows the treatment of the fabric with a detergent composition.

The compositions of the invention comprise water, preferably in an amount of from 0.01% to 90% by weight, more preferably from 1% to 75% by weight.

If the composition of the present invention is in the form of a detergent composition, it preferably comprises any one of soap and non-soap anionic, cationic, nonionic, amphoteric and zwitterionic detergent active compounds, and mixtures thereof.

Many suitable detergent active compounds are available and are fully described in the literature, for example, in "Surface-Active Agents and Detergents", Volumes I and II, by Schwartz, Perry and Berch.

The preferred textile-compatible carriers that can be used are soaps and synthetic non-soap anionic and nonionic compounds.

Anionic surfactants are well known to those skilled in the art. Examples include alkylbenzene sulphonates, particularly linear alkylbenzene sulphonates having an alkyl chain length of $C_8$–$C_{15}$; primary and secondary alkylsulphates, particularly $C_8$–$C_{15}$ primary alkyl sulphates; alkyl ether sulphates; olefin sulphonates; alkyl xylene sulphonates; dialkyl sulphosuccinates; and fatty acid ester sulphonates. Sodium salts are generally preferred.

Nonionic surfactants that may be used include the primary and secondary alcohol ethoxylates, especially the $C_8$–$C_{20}$ aliphatic alcohols ethoxylated with an average of from 1 to 20 moles of ethylene oxide per mole of alcohol, and more especially the $C_{10}$–$C_{15}$ primary and secondary aliphatic alcohols ethoxylated with an average of from 1 to 10 moles of ethylene oxide per mole of alcohol. Non-ethoxylated nonionic surfactants include alkylpolyglycosides, glycerol monoethers, and polyhydroxyamides (glucamide).

Cationic surfactants that may be used include quaternary ammonium salts of the general formula $R_1R_2R_3R_4N^+ X^-$ wherein the R groups are independently hydrocarbyl chains of $C_1$–$C_{22}$ length, typically alkyl, hydroxyalkyl or ethoxylated alkyl groups, and X is a solubilising cation (for example, compounds in which $R_1$ is a $C_8$–$C_{22}$ alkyl group, preferably a $C_8$–$C_{10}$ or $C_{12}$–$C_{14}$ alkyl group, $R_2$ is a methyl group, and $R_3$ and $R_4$, which may be the same or different, are methyl or hydroxyethyl groups); and cationic esters (for example, choline esters) and pyridinium salts.

The total quantity of detergent surfactant in the composition is suitably from 0.1 to 60 wt % e.g. 0.5–55 wt %, such as 5–50 wt %.

Preferably, the quantity of anionic surfactant (when present) is in the range of from 1 to 50% by weight of the total composition. More preferably, the quantity of anionic surfactant is in the range of from 3 to 35% by weight, e.g. 5 to 30% by weight.

Preferably, the quantity of nonionic surfactant when present is in the range of from 2 to 25% by weight, more preferably from 5 to 20% by weight.

Amphoteric surfactants may also be used, for example amine oxides or betaines.

The compositions may suitably contain from 10 to 70%, preferably from 15 to 70% by weight, of detergency builder. Preferably, the quantity of builder is in the range of from 15 to 50% by weight for granular compositions and 1 to 10% by weight for liquid compositions."

One type of preferred builders are based on phosphates, in particular sodium tripolyphosphate.

The detergent composition may contain as builder a crystalline aluminosilicate, preferably an alkali metal aluminosilicate, more preferably a sodium aluminosilicate.

The aluminosilicate may generally be incorporated in amounts of from 10 to 70% by weight (anhydrous basis), preferably from 25 to 50%. Aluminosilicates are materials having the general formula:

$$0.8\text{–}1.5M_2O.\ Al_2O_3.\ 0.8\text{–}6SiO_2$$

where M is a monovalent cation, preferably sodium. These materials contain some bound water and are required to have a calcium ion exchange capacity of at least 50 mg CaO/g. The preferred sodium aluminosilicates contain 1.5–3.5 $SiO_2$ units in the formula above. They can be prepared readily by reaction between sodium silicate and sodium aluminate, as amply described in the literature.

Bleaching systems may be present in the fabric treatment compositions. Preferred bleaching systems are based on per-oxygen bleaches such as alkali metal peroxides, organic peroxide bleaching compounds, especially preferred are perborate or percarbonate based systems.

The preferred level of bleach present in the composition is from 1 to 35% by weight of the total composition, preferably from 5 to 25% by weight.

It is also preferred if the bleaching system comprises a peroxyacid bleach precursors or activators such as sodium-4-benzoyloxy benzene sulphonate (SBOBS); N,N,N'N'-tetraacetyl ethylene diamine (TAED); sodium-1-methyl-2-benzoyloxy benzene-4-sulphonate; sodium-4-methyl-3-benzoloxy benzoate; SSPC; trimethyl ammonium toluyloxybenzene sulphonate; sodium nonanoyloxybenzene sulphonate (SNOBS); sodium 3,5,5-trimethyl hexanoyloxybenzene sulphonate (STHOBS); and the substituted cationic nitrites. Each of the above precursor may also be applied in mixtures.

The detergent compositions of the present invention may additionally comprise one or more detersive enzymes, which provide cleaning performance, fabric care and/or sanitation benefits.

Said enzymes include lipases, amylases, cellulases and mixtures thereof.

If the composition of the present invention is in the form of a fabric conditioner composition, the textile-compatible carrier will be a fabric softening and/or conditioning compound (hereinafter referred to as "fabric softening compound"), which may be a cationic or nonionic compound.

The softening and/or conditioning compounds may be water insoluble quaternary ammonium compounds. The compounds may be present in amounts of up to 8% by weight (based on the total amount of the composition) in which case the compositions are considered dilute, or at levels from 8% to about 50% by weight, in which case the compositions are considered concentrates.

Compositions suitable for delivery during the rinse cycle may also be delivered to the fabric in the tumble dryer if used in a suitable form. Thus, another product form is a composition (for example, a paste) suitable for coating onto, and delivery from, a substrate e.g. a flexible sheet or sponge or a suitable dispenser during a tumble dryer cycle.

Suitable cationic fabric softening compounds are substantially water-insoluble quaternary ammonium materials comprising a single alkyl or alkenyl long chain having an average chain length greater than or equal to $C_{20}$ or, more preferably, compounds comprising a polar head group and two alkyl or alkenyl chains having an average chain length greater than or equal to $C_{14}$. Preferably the fabric softening compounds have two long chain alkyl or alkenyl chains each having an average chain length greater than or equal to $C_{16}$. Most preferably at least 50% of the long chain alkyl or alkenyl groups have a chain length of $C_{18}$ or above. It is preferred if the long chain alkyl or alkenyl groups of the fabric softening compound are predominantly linear.

Quaternary ammonium compounds having two long-chain aliphatic groups, for example, distearyldimethyl ammonium chloride and di(hardened tallow alkyl) dimethyl ammonium chloride, are widely used in commercially available rinse conditioner compositions. Other examples of these cationic compounds are to be found in "Surface-Active Agents and Detergents", Volumes I and II, by Schwartz, Perry and Berch. Any of the conventional types of such compounds may be used in the compositions of the present invention.

The fabric softening compounds are preferably compounds that provide excellent softening, and are characterised by a chain melting Lβ to Lα transition temperature greater than 25° C., preferably greater than 35° C., most preferably greater than 45° C. This Lβ to Lα transition can be measured by DSC as defined in "Handbook of Lipid Bilayers", D Marsh, CRC Press, Boca Raton, Fla., 1990 (pages 137 and 337).

Substantially water-insoluble fabric softening compounds are defined as fabric softening compounds having a solubility of less than $1\times10^{-3}$ wt % in demineralised water at 20° C. Preferably the fabric softening compounds have a solubility of less than $1\times10^{-4}$ wt %, more preferably less than $1\times10^{-8}$ to $1\times10^{-6}$ wt %.

Especially preferred are cationic fabric softening compounds that are water-insoluble quaternary ammonium materials having two $C_{12\text{-}22}$ alkyl or alkenyl groups connected to the molecule via at least one ester link, preferably two ester links. An especially preferred ester-linked quaternary ammonium material can be represented by the formula II:

(II)

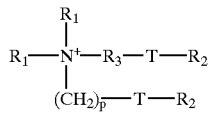

wherein each $R_1$ group is independently selected from $C_{1\text{-}4}$ alkyl or hydroxyalkyl groups or $C_{2\text{-}4}$ alkenyl groups; each $R_2$ group is independently selected from $C_{8\text{-}28}$ alkyl or alkenyl groups; and wherein $R_3$ is a linear or branched alkylene group of 1 to 5 carbon atoms, T is

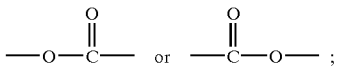

and p is 0 or is an integer from 1 to 5.

Di(tallowoxyloxyethyl) dimethyl ammonium chloride and/or its hardened tallow analogue is especially preferred of the compounds of formula (II).

A second preferred type of quaternary ammonium material can be represented by the formula (III):

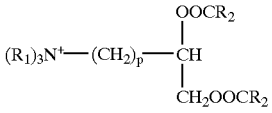

(III)

wherein $R_1$, p and $R_2$ are as defined above.

It is advantageous if the quaternary ammonium material is biologically biodegradable.

Preferred materials of this class such as 1,2-bis(hardened tallowoyloxy)-3-trimethylammonium propane chloride and their methods of preparation are, for example, described in U.S. Pat. No. 4,137,180 (Lever Brothers Co). Preferably these materials comprise small amounts of the corresponding monoester as described in U.S. Pat. No. 4,137,180, for example, 1-hardened tallowoyloxy-2-hydroxy-3-trimethylammonium propane chloride.

Other useful cationic softening agents are alkyl pyridinium salts and substituted imidazoline species. Also useful are primary, secondary and tertiary amines and the condensation products of fatty acids with alkylpolyamines.

The compositions may alternatively or additionally contain water-soluble cationic fabric softeners, as described in GB 2 039 556B (Unilever).

The compositions may comprise a cationic fabric softening compound and an oil, for example as disclosed in EP-A-0829531.

The compositions may alternatively or additionally contain the polyol polyester (eg, sucrose polyester) compounds described in WO 98/16538.

The compositions may comprise a cationic fabric softening compound and an oil, for example as disclosed in EP-A-0829531.

The compositions may alternatively or additionally contain nonionic fabric softening agents such as lanolin and derivatives thereof.

Lecithins are also suitable softening compounds.

Nonionic softeners include Lβ phase forming sugar esters (as described in M Hato et al Langmuir 12, 1659, 1666, (1996)) and related materials such as glycerol monostearate or sorbitan esters. Often these materials are used in conjunction with cationic materials to assist deposition (see, for example, GB 2 202 244). Silicones are used in a similar way as a co-softener with a cationic softener in rinse treatments (see, for example, GB 1 549 180).

The compositions may also suitably contain a nonionic stabilising agent. Suitable nonionic stabilising agents are linear $C_8$ to $C_{22}$ alcohols alkoxylated with 10 to 20 moles of alkylene oxide, $C_{10}$ to $C_{20}$ alcohols, or mixtures thereof.

Advantageously the nonionic stabilising agent is a linear $C_8$ to $C_{22}$ alcohol alkoxylated with 10 to 20 moles of alkylene oxide. Preferably, the level of nonionic stabiliser is within the range from 0.1 to 10% by weight, more preferably from 0.5 to 5% by weight, most preferably from 1 to 4% by weight. The mole ratio of the quaternary ammonium compound and/or other cationic softening agent to the nonionic stabilising agent is suitably within the range from 40:1 to about 1:1, preferably within the range from 18:1 to about 3:1.

The composition can also contain fatty acids, for example $C_8$ to $C_{24}$ alkyl or alkenyl monocarboxylic acids or polymers thereof. Preferably saturated fatty acids are used, in particular, hardened tallow $C_{16}$ to $C_{18}$ fatty acids. Preferably the fatty acid is non-saponified, more preferably the fatty acid is free, for example oleic acid, lauric acid or tallow fatty acid. The level of fatty acid material is preferably more than 0.1% by weight, more preferably more than 0.2% by weight. Concentrated compositions may comprise from 0.5 to 20% by weight of fatty acid, more preferably 1% to 10% by weight. The weight ratio of quaternary ammonium material or other cationic softening agent to fatty acid material is preferably from 10:1 to 1:10.

The fabric conditioning compositions may include silicones, such as predominately linear polydialkylsiloxanes, e.g. polydimethylsiloxanes or aminosilicones containing amine-functionalised side chains; soil release polymers such as block copolymers of polyethylene oxide and terephthalate; amphoteric surfactants; smectite type inorganic clays; zwitterionic quaternary ammonium compounds; and nonionic surfactants.

The fabric conditioning compositions may be in the form of emulsions or emulsion precursors thereof.

Other optional ingredients include emulsifiers, electrolytes (for example, sodium chloride or calcium chloride) preferably in the range from 0.01 to 5% by weight, pH buffering agents, and perfumes (preferably from 0.1 to 5% by weight).

Further optional ingredients in the compositions of the invention include non-aqueous solvents, perfume carriers, fluorescers, colourants, hydrotropes, antifoaming agents, antiredeposition agents, optical brightening agents, opacifiers, dye transfer inhibitors, anti-shrinking agents, anti-wrinkle agents, anti-pilling agents, anti-fuzzing agents, anti-spotting agents, germicides, fungicides, anti-oxidants, UV absorbers (sunscreens), heavy metal sequestrants, chlorine scavengers, dye fixatives, anti-corrosion agents, drape imparting agents, antistatic agents, ironing aids, bleach systems and soil release agents. This list is not intended to be exhaustive.

The compositions of the invention may also include an agent, which produces a pearlescent appearance, e.g. an organic pearlising compound such as ethylene glycol distearate, or inorganic pearlising pigments such as microfine mica or titanium dioxide ($TiO_2$) coated mica.

An anti-settling agent may be included in the compositions of the invention. The anti-settling agent, which reduces the tendency of solid particles to separate out from the remainder of a liquid composition, is preferably used in an amount of from 0.5 to 5% by weight of the composition. Organophilic quaternised ammonium-clay compounds and fumed silicas are examples of suitable anti-settling agents.

A further optional ingredient in the compositions of the invention is a flocculating agent which may act as a delivery aid to enhance deposition of the active ingredients (such as the water insoluble particles) onto fabric. Flocculating agents may be present in the compositions of the invention in amounts of up to 10% by weight, based on the weight of the organoclay. Suitable flocculating agents include polymers, for example long chain polymers and copolymers comprising repeating units derived from monomers such as ethylene oxide, acrylamide, acrylic acid, dimethylaminoethyl methacrylate, vinyl alcohol, vinyl pyrrolidone, ethylene imine and mixtures thereof. Gums such as guar gum, optionally modified, are also suitable for use as flocculating agents.

Other possible delivery aids for the water insoluble particles include, for example, the water-soluble or water-dispersible rebuild agents (e.g., cellulose monoacetate) described in WO 00/18860.

The invention will now be described by way of example only and with reference to the following non-limiting examples. In the examples and throughout this specification all percentages are percentages by weight unless indicated otherwise.

EXAMPLES

The coated particles used for the following experiment had a 'silica to silicone' ratio of 50:50 and was supplied in the form of a 20% aqueous emulsion as described in JP 10/114 622.

The experiment was performed using Tergotometers throughout.

The detergent employed was Persil Performance (January 2001 ex. Lever Bros.) at a concentration of 3 g/l.

The fabric conditioner used was Comfort, regular blue dilute (January 2001 ex. Lever Bros.), at a concentration of 6.5 g/l for the Terry towelling and 4 g/l for the sheeting and polycotton.

The liquor:cloth ratio employed throughout was 25:1. Washing was conducted at 40° C. for 30 minutes followed by rinsing in cold water for 5 minutes. The final rinse was conducted for 5 minutes at 20° C. Wirral water was employed throughout.

The fabric samples used were:

A. Prewashed Terry towelling, 2 pieces ~15 cm by 15 cm.
B. A mixture of prewashed sheeting and 50:50 polycotton, 2 pieces each, ~15 cm by 15 cm.

Six sets of fabrics were prepared as follows:

1. Control Washed with Persil.
2. Example Washed with Persil with added coated particles (3 g/l) in the mainwash. This represents a particle concentration of 16.7% on weight of formulation.
3. Example Washed with Persil in the main wash. Coated particles (3 g/l) added to the final rinse.
4. Control Washed with Persil in the main wash and treated in the final rinse with Comfort.
5. Example Washed with Persil in the main wash, and treated in the final rinse with Comfort and coated particles (1.5 g/l). This represents coated particle concentrations of 4.4% on weight of formulation for the Terry Towelling and 7.0% for the sheeting/polycotton fabrics.
6. Control Washed with Persil and treated with starch in the final rinse(6.5 g/l).

After washing the fabric samples were hydroextracted and tumble-dried.

The following pairs of treated fabric were panel assessed:

1. Vs 2. for softness.
1. Vs 3. for softness.
3. Vs 5. for greasiness and crispness.
4. Vs 5. for greasiness and crispness.
3. Vs 6. for softness.

The percentage score relate to the fabric the panellist chose. A high percentage represents a high preference for that fabric that is it feels soft or crisp.

1. vs 2. for Softness:

| | |
|---|---|
| Terry towelling | 38%:63% |

The mainwash particulate treated fabric came out softer for Terry towelling.

1. vs 3. for Softness:

| | |
|---|---|
| Terry towelling | 25%:75% |
| Sheeting | 25%:75% |
| Polycotton | 25%:75% |

The colloidal silica core shell substance treated in the rinse fabric came out softer that the washed only fabric.

3. vs 5. for Greasiness and Crispness:

| | |
|---|---|
| Terry towelling | 100%:0% |
| Sheeting | 100%:0% |
| Polycotton | 100%:0% |

The colloidal silica core shell substance treated in the rinse fabric came out less greasy and crisper than the Comfort treated fabric every time.

4. vs 5. for Greasiness and Crispness:

| | |
|---|---|
| Terry towelling | 31%:69% |
| Sheeting | 25%:75% |
| Polycotton | 25%:75% |

The particulate and Comfort treated fabric came out less greasy and crisper than the Comfort only treated fabric.

2. vs 6. for Softness:

| | |
|---|---|
| Terry towelling | 38%:63% |
| Sheeting | 12%:88% |
| Polycotton | 0%:100% |

The particulate treated fabric came out softer than starch treated fabric.

What is claimed is:

1. A method of treating fabric comprising the step of applying to the fabric a fabric treatment composition comprising a coated particle comprising: a solid core having a D3,2 average particle size in the range from 10 to 700 nm, and a coating of silicone polymer covalently bonded to the solid core.

2. A fabric treatment composition comprising i) a coated particle comprising:

a solid core having a D3,2 average particle size in the range from 10 to 700 nm, and a coating of silicone polymer covelently bonded to the solid core and;

ii) a builder.

3. A fabric treatment composition comprising:

i) a coated particle comprising:

a solid core having a D3,2 average particle size in the range from 10 to 700 nm, and a coating of silicone polymer covalently bonded to the solid core and;

ii) a fabric softening compound.

4. A fabric treatment composition comprising:

i) a coated particle comprising :

a solid core having a D3,2 average particle size in the range from 10 to 700 nm, and a coating of silicone polymer covalently bonded to the solid core and;

ii) a bleaching system.

5. A fabric treatment composition comprising:

i) a coated particle comprising:

a solid core having a D3,2 average particle size in the range from 10 to 700 nm, and a coating of silicone polymer covalently bonded to the solid core and;

ii) detersive enzymes.

6. A fabric treatment composition according to claim 1 in which the weight ratio of the solid core to the silicone coating polymer is in the range from 20:1 to 1:10.

7. A fabric treatment composition according to claim 1 in which the solid core comprises material selected from cross-linked polymers, PTFE, alumina, alumino silicate and colloidal metals.

8. A fabric treatment composition according to claim 1 in which the solid core is a colloidal silica.

9. A fabric treatment composition according to claim 1 in which the silicone polymer is a polyorganosiloxane.

10. A method of use of a coated particles comprising a solid core having a D3,2 average particle size in the range from 10 to 700 nm, and a coating of silicone polymer covalently bonded to the solid core to impart a crisp feel to the fabric.

11. A method of use of a coated particle comprising a solid core having a D3,2 average particle size in the range from 10 to 700 nm, and a coating of silicone polymer covalently bonded to the solid core to impart a soft feel to the fabric.

12. A method of use of a coated particle comprising a solid core having a D3,2 average particle size in the range from 10 to 700 nm, and a coating of silcone polymer covalently bonded to the solid core to impart body to the fabric.

13. A fabric treatment composition according to claim 1 in which the weight ratio of the solid core to the silicone coating polymer is in the range from 20:1 to 2:3.

14. A fabric treatment composition according to claim 1 in which the weight ratio of the solid core to the silicone coating polymer in the range from 20.1 to 1:1.

* * * * *